US005201876A

United States Patent [19]

Stengel

[11] Patent Number: 5,201,876

[45] Date of Patent: Apr. 13, 1993

[54] METHOD OF ADJUSTING THE IMPACT ENERGY OF A LETTER KEY OR TYPE ELEMENT OF A PRINTING MACHINE AND TYPEWRITER, PRINTER OR THE LIKE PRINTING MACHINE USING THAT METHOD

[75] Inventor: Werner Stengel, Langenzenn, Fed. Rep. of Germany

[73] Assignee: TA Triumph-Adler AG, Fed. Rep. of Germany

[21] Appl. No.: 739,696

[22] Filed: Aug. 2, 1991

[30] Foreign Application Priority Data

Aug. 10, 1990 [DE] Fed. Rep. of Germany ..... 4025359

[51] Int. Cl.[5] ..... B41J 9/48

[52] U.S. Cl. ..... 400/166; 400/157.3; 101/93.03

[58] Field of Search ..... 400/157.2, 157.3, 166, 400/167, 55, 56, 57; 101/93.02, 93.03, 93.14

[56] References Cited

U.S. PATENT DOCUMENTS

| | | | |
|---|---|---|---|
| 4,173,927 | 11/1979 | Van Kempen et al. | 400/166 |
| 4,547,087 | 10/1985 | Heider et al. | 400/166 |
| 4,797,017 | 1/1989 | Okouchi | 400/157.3 |
| 4,880,322 | 11/1989 | Jensen et al. | 400/167 |
| 4,911,568 | 3/1990 | Makiura | 400/157.3 |

OTHER PUBLICATIONS

IBM Technical Disclosure Bulletin, vol. 28, No. 10, Mar. 1986 "Algorithm for Magnetic Sensing of Print Actuator Dynamics".

IBM Technical Disclosure Bulletin vol. 24 No. 3 Aug. 1981 "Print Velocity Pendulum".

IBM Technical Disclosure Bulletin vol. 32 No. 8A Jan. 1990 "Print Hammer Impact Detection Circuit".

*Primary Examiner*—David A. Wiecking

*Assistant Examiner*—Lynn D. Hendrickson

[57] ABSTRACT

The method for determining impact energy of a type element of the printing machine includes providing at least two different-length flight paths for the type elements by changing a distance between a resting position of the hammer and a place of impact of the type elements by at least one known amount; measuring at least two different hammer flight times corresponding to the at least two different-length flight paths of the type elements differing by the at least one known amount, each of the different hammer flight times being equal to a difference between a time of impact of one of the type elements and a time of onset of current flow in the hammer electromagnet; forming a difference between two different hammer flight times; dividing the known amount by which the two flight paths associated with the two different hammer flight times differ by the difference determined for the two hammer flight times to obtain a speed of the type element at impact and thus the impact energy of the type element. By comparing the actual value of the hammer flight time differences with a set value for the flight time differences the impact energy of a type element can be electronically controlled by controlling current flow in the hammer electromagnet.

5 Claims, 2 Drawing Sheets

METHOD OF ADJUSTING THE IMPACT ENERGY OF A LETTER KEY OR TYPE ELEMENT OF A PRINTING MACHINE AND TYPEWRITER, PRINTER OR THE LIKE PRINTING MACHINE USING THAT METHOD

BACKGROUND OF THE INVENTION

The present invention relates to a method of adjusting and/or correcting the impact energy of a letter key or type element of a typewriter, printer or the like printing machine, and also to the typewriter, printer and/or other printing machine which uses that method.

A printing machine is known, in which a type element or letter key is pressed against a substrate by a hammer accelerated by a hammer electromagnet. The hammer flight time determines the magnitude of the impact energy and the duration of current flow in the hammer electromagnet is adjusted according to that.

It is important that the impact of the letter key or the type element on the substrate, e.g. a paper guided around a typewriter roll, occurs with a definite predetermined impact energy, so that a uniform type character with sufficiently strong impression results, while avoiding damage to the substrate.

The impact energy of the key or type element is proportional to the square of the speed at the moment of impact. The impact speed of the type element and/or the hammer is produced because the hammer electromagnet accelerates the hammer with a certain current level flow through the electromagnet for a predetermined current flow duration. After this acceleration stage, a motion stage occurs without acceleration, in which the hammer up to the time of impact moves toward the type element and/or the substrate with a uniform speed. Since the geometric relationships and dimensions, i.e. especially the path of the hammer to impact, remain the same, the free flight time is directly proportional to the free flight speed and produces accordingly a certain impact energy.

Conventionally the free flight speed of the hammer is measured in production of the typewriter or printer with different measuring methods and is stored in the data memory of the central data processing unit of the typewriter or printer, so that, when a certain type element or letter key is activated, an appropriate current flow duration results, which leads to the desired impact energy.

Determination of a certain current flow duration in advance for the hammer electromagnet for a certain type element has not previously taken into account variations in the impact conditions due to manufacturing conditions and changes with increasing operating time.

SUMMARY OF THE INVENTION

It is an object of the present invention to provide a method of adjusting the impact energy of a letter key or type element of a printing machine to compensate for manufacturing tolerances and operational variations by adjusting the actual free flight speed of a letter key or type element during operation and/or when first put into service.

It is also an object of the present invention to guarantee that, during operation of the typewriter or printing machine, the actual impact energy of a letter key or type element is controlled so that the striking of the letter key or type element is adjustable and occurs with a desired impact energy independent of manufacturing tolerances or operational variations.

According to the invention, the method for determining the impact energy of a letter key or type element includes determining a time of impact of the hammer and/or a type element or letter key on the substrate being printed and/or on the typewriter roll guiding the substrate by a sensing means including a sensor and a processor means including a memory connected with the sensing means, determining a time of onset of current flow in the hammer electromagnet for the flight path associated with the impact detected by the sensing means, determining the hammer flight time for the corresponding flight path as the difference of the time of onset of current in the electromagnet and the time of impact determined by the sensing means, and repeating the determination of hammerflight time for at least one other different-length flight path.

The flight time of at least one of the letter keys or type elements and its impact energy is controlled by changing the current flow in the hammer electromagnet according to an actual value of a difference between the flight times for two different-length flight paths and a set value.

Since the free flight speed and thus the speed at impact is just the quotient of a flight path difference and a time difference between the flight durations for the different flight paths, then from the flight time difference, when, the flight path length difference is known, the flight speed at impact can be determined by division and thus the impact energy can be thus be derived from that.

Different free flight paths can be obtained, according to one embodiment of the invention, by measuring successive impact of different type elements or letter keys of different thickness. If, e.g., one type element of a type wheel with a greater thickness than another type element is struck by the same hammer, thus the free flight path of the hammer is shortened. The path differences in the path of the hammer can be directly related to thickness differences of the type elements struck in succession.

In another embodiment of the invention different length free flight paths for the same letter key or type element are obtained by insertion of a strip of material of thickness between the strip of material and the substrate in the vicinity of the impact. Therefore one and the same type element or letter key directly strikes the substrate or the typewriter roll one time and immediately after that impacts with the material strip intervening. Consequently, different flight times result, so that the free flight speed can be obtained from the flight time difference and the flight path difference which is equal to the thickness of the material strip.

Because of the features of the inventive method all variables, which are relevant to the acceleration region of the hammer, are not considered and only the free flight speed is taken into consideration and determined.

A microphone, for example, can be used as sensor for detection of the occurrence of the hammer impact on the typewriter substrate and/or the typewriter roll. This microphone converts the sound of the impact into an electrical signal which is received by a processor means which determines the impact time.

To be sure that a running adjustment of the impact energy in cases of variation of the impact energy from a predetermined set value occurs properly, the microphone can be attached rigidly to the typewriter or printer, and an adjustment is performed by comparison with stored set value flight time difference for two known type elements during the typewriter operation and by current flow duration in the hammer electromagnet performed according to that comparison.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE PREFERRED EMBODIMENTS

Figure 1:
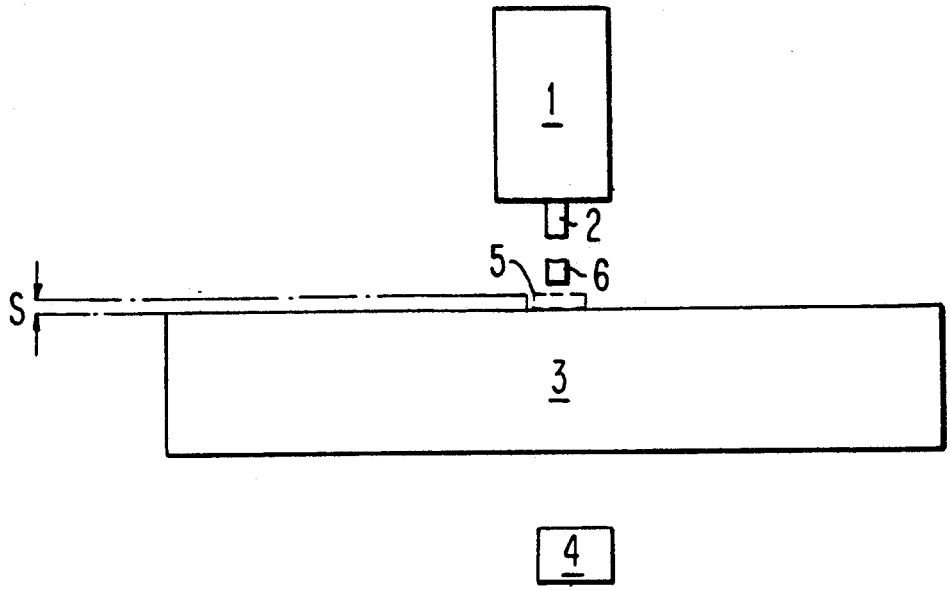
FIG. 1 is schematic block diagram showing one embodiment of a device used to perform the method according to the invention as applied to a typewriter.
Figure 2:
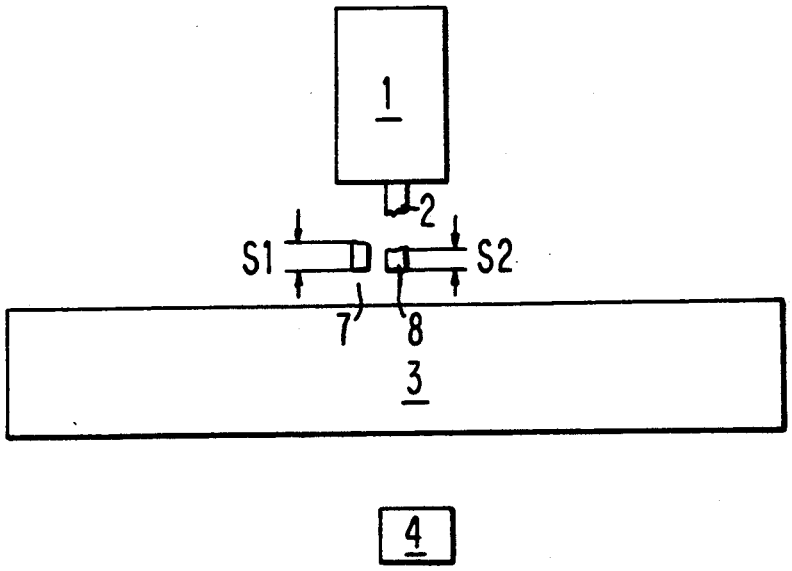
FIG. 2 is a schematic block diagram of another embodiment of a device used to perform the method according to the invention as applied to a typewriter.

A hammer electromagnet 1, which is formed as a substantially cylindrical electromagnet, is shown in FIGS. 1 and 2. A hammer 2 longitudinally slidable in the hammer electromagnet 1 is positioned to be accelerated in the direction of a typewriter roll 3. A sensing means 4, e.g. including a microphone, is provided on the other side of the typewriter roll 3 from that of the hammer electromagnet 1. This sensing means 4 detects the impact of the type element 6 on the typewriter roll 3.

A processor means 9 is connected to sensing means 4 to receive signals from the sensing means 4 and to store a time of impact of the type element 6 determined from the signals received from the sensing means 4. The processor means 9 is also connected to and controls the current flow in the hammer electromagnet 1.

In the embodiment shown in FIG. 1, a strip of material 5 of thickness S can be put between a type element 6 receiving the impact of the hammer and the typewriter roll 3 so as to shorten the free flight of the hammer 2 and to allow the determination of the flight time difference between the impact times of the type element 6 with and without the intervening strip of material 5.

Figure 3:
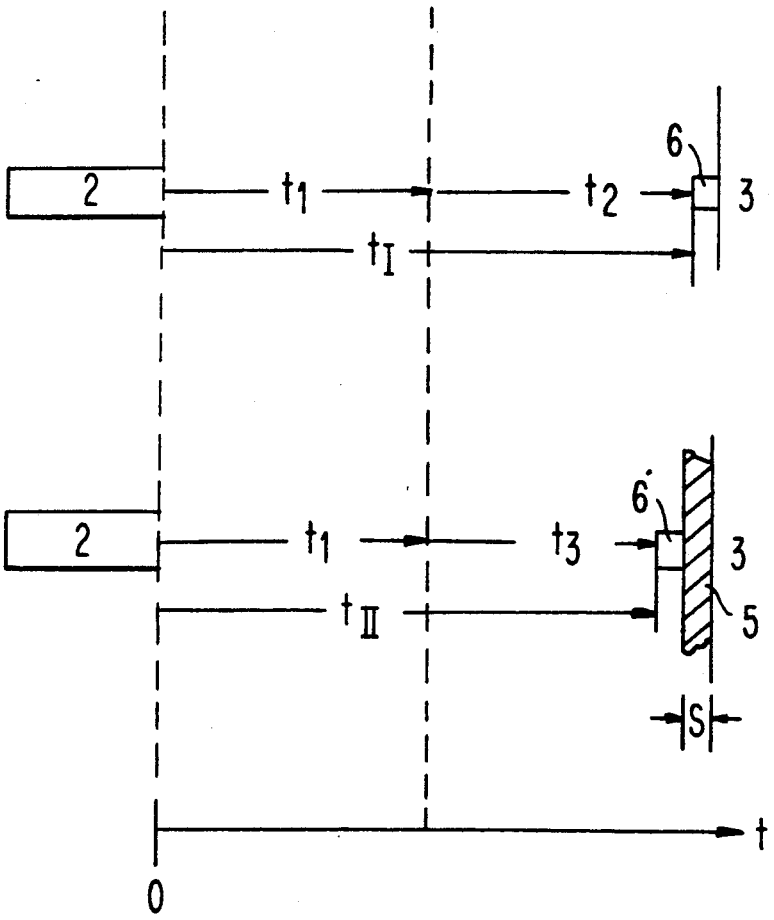
FIG. 3 is a graphical illustration of the flight time determination according to one embodiment of the method of the invention.

In the method according to FIG. 1 as shown diagrammatically in FIG. 3 the hammer 2 drives the type element 6 to impact on the typewriter roll 3. The flight time $t_I$ between onset of current in the electromagnet and impact of the type element 6 on the substrate consists of an acceleration time $t_1$ plus a free flight time $t_2$ during which its speed is constant. The flight time is measured as the difference between the impact time of the type element 6 and the time current flow in the electromagnet and is stored in the memory of processor means 9. Then the strip of material 5 is interposed between the typewriter element 6 in the vicinity of the place of impact and the typewriter roll 3. The flight time $t_{II}$ is measured again as the difference between the time current flows in the electromagnet and the time of impact and is also stored in the memory of the processor means 9. The free flight time $t_3$ and thus the flight time $t_{II}$ differs from the previously measured values without the strip of material 5 present, because the strip of material 5 changes the free flight time, however the type element speed will be the same. Then the speed of the type element 6 can be determined since it equals the thickness S of the strip of material 5 divided by the difference of the flight times $t_I - t_{II}$ stored in the processor means 9.

In the embodiment according to FIG. 2, a flight time difference is attained, because type elements 7 and with different thicknesses S1 and/or S2 impact one after the other. Just as in the embodiment according to FIG. 1 the flight time difference the known thickness difference S1−S2 allows one to determine the free flight speed and thus provides information on the determination of the impact energy.

While the invention has been illustrated and described as embodied in a method of adjusting the impact energy of a letter key or type element and typewriter, printer and the like printing machine using that method, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

I claim:

1. Method for determining an impact energy of a type element of a printing machine, said printing machine comprising a roll for supporting a substrate; a hammer electromagnet and a hammer associated with the hammer electromagnet, said hammer being moveable by a current flow through the hammer electromagnet; a plurality of type elements, each of the type elements being positionable relative to the hammer to impact the substrate on the roll when the hammer is energized by the hammer electromagnet; and sensing means for detecting an impact of one of the type elements on the substrate, the method comprising the steps of:

a. providing at least two different-length flight paths for the type elements by changing a distance between a resting position of the hammer and a place of impact of the type elements by at least one known amount;

b. measuring at least two different hammer flight times corresponding to the at least two different-length flight paths of the type elements differing by the at least one known amount, each of the different hammer flight times being equal to a difference between a time of impact of one of the type elements and a time of onset of the current flow in the hammer electromagnet;

c. forming a difference between two of the different hammer flight times;

d. dividing the at least one known amount by which the two different-length flight paths associated with the two different hammer flight times differ by the difference determined in step c) for the two different hammer flight times to obtain a speed of the type element at impact and thus the impact energy of the type element.

2. The method as defined in claim 1, further comprising providing each of said two different-length flight paths by using a different one of said type elements having a different thickness.

3. The method as defined in claim 1, further comprising providing each of said two different-length flight paths by using the same one of said type elements and interposing a material strip of a known thickness between the type element and the substrate to provide at least one of the different-length flight paths.

4. The method as defined in claim 1, wherein said sensing means includes a microphone attached to said printing machine.

5. Method for adjusting an impact energy of a type element of a printing machine, said printing machine comprising a roll for support a substrate; a hammer electromagnet and a hammer associated with the hammer electromagnet, said hammer being moveable by a current flow through the hammer electromagnet; a plurality of type elements, each of the type elements being positionable relative to the hammer to impact the substrate on the roll when the hammer is energized by the current flow through the hammer electromagnet; a memory; and sensing means for detecting an impact of one of the type elements on the substrate, the method comprising the steps of:

a. providing at least two different-length flight paths for the type elements by changing a distance between a resting position of the hammer and a place of impact of the type elements by at least one known amount;

b. measuring at least two different hammer flight times corresponding to the at least two different-length flight paths of the type elements differing by the at least one known amount, each of the different hammer flight times being equal to a difference between a time of impact of one of the type elements and a time of onset of the current flow in the hammer electromagnet;

c. forming a difference between two of the different hammer flight times;

d. dividing the known amount by which the two different-length flight paths associated with the two different hammer flight times differ by the difference determined in step c) for the two different hammer flight times to obtain a speed of the type element at impact and thus the impact energy of the type element;

e. storing a set value of the two hammer flight time differences in the memory of said printing machine;

f. comparing the set value of the two flight time differences with the difference between the two different hammer flight times determined in step c); and g. controlling the current flow in the hammer electromagnet according to the comparing of the set value of the flight time differences and the difference between the two hammer flight times determined in step c) to perform an adjustment of the impact energy of one of the type elements associated with one of the two different-length flight paths.

* * * * *